US008244438B2

(12) United States Patent
Koch et al.

(10) Patent No.: US 8,244,438 B2
(45) Date of Patent: Aug. 14, 2012

(54) TOOL CONTROL SYSTEM

(75) Inventors: Roger Dale Koch, Pekin, IL (US); Daniel Francis Stanek, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 1016 days.

(21) Appl. No.: 12/010,987

(22) Filed: Jan. 31, 2008

(65) Prior Publication Data

US 2009/0198382 A1 Aug. 6, 2009

(51) Int. Cl.

| | |
|---|---|
| ***G06F 7/70*** | (2006.01) |
| ***G06F 19/00*** | (2006.01) |
| ***G06G 7/00*** | (2006.01) |
| ***G06G 7/76*** | (2006.01) |
| ***G01M 1/38*** | (2006.01) |

(52) U.S. Cl. ..... 701/50; 700/275; 212/284

(58) Field of Classification Search ..... 701/50; 700/275; 212/284

See application file for complete search history.

(56) References Cited

U.S. PATENT DOCUMENTS

| | | | | |
|---|---|---|---|---|
| 3,978,784 | A * | 9/1976 | Bryce et al. | 100/170 |
| 4,173,836 | A | 11/1979 | Paurat | |
| 4,301,607 | A | 11/1981 | Inui | |
| 4,910,673 | A | 3/1990 | Narisawa et al. | |
| 4,978,273 | A * | 12/1990 | Radke et al. | 414/697 |
| 5,308,219 | A | 5/1994 | Lee et al. | |
| 5,429,037 | A * | 7/1995 | Weber et al. | 91/522 |
| 5,480,276 | A * | 1/1996 | Mozingo | 414/685 |
| 5,513,552 | A * | 5/1996 | Ardelt | 91/522 |
| 5,572,809 | A | 11/1996 | Steenwyk et al. | |
| 5,707,182 | A | 1/1998 | Leffer | |
| 5,768,810 | A | 6/1998 | Ahn | |
| 5,782,018 | A | 7/1998 | Tozawa et al. | |
| 5,799,419 | A | 9/1998 | Seo et al. | |
| 5,903,988 | A | 5/1999 | Tochizawa et al. | |
| 6,233,511 | B1 | 5/2001 | Berger et al. | |
| 6,266,901 | B1 | 7/2001 | Kanda et al. | |

(Continued)

FOREIGN PATENT DOCUMENTS

| | | |
|---|---|---|
| CN | 1651666 | 8/2005 |

(Continued)

*Primary Examiner* — Christopher J. Novosad
(74) *Attorney, Agent, or Firm* — Finnegan, Henderson, Farabow, Garrett & Dunner LLP

(57) ABSTRACT

A tool control system is disclosed. The control system may have a first actuator configured to control a first linkage. The control system may further have a second actuator configured to control a second linkage. The control system may also have a third actuator configured to control a work tool, wherein the second linkage is connected to the work tool and movably connected to the first linkage. The control system may still further have a plurality of operator input devices configured to provide operator control of the first, second, and third actuators. The control system may also have a controller in communication with the first, second, and third actuators and the plurality of operator input devices. The controller may be configured to receive a desired tool path for the work tool. The controller may also be configured to control movement of the first, second, and third actuators based on operator input received from fewer than all of the plurality of operator input devices to move the work tool along the desired tool path.

20 Claims, 3 Drawing Sheets

U.S. PATENT DOCUMENTS

| | | | |
|---|---|---|---|
| 6,542,789 | B2 | 4/2003 | Ufheil |
| 6,604,305 | B2 | 8/2003 | Koch |
| 6,763,619 | B2 | 7/2004 | Hendron et al. |
| 6,968,264 | B2 | 11/2005 | Cripps |
| 7,007,415 | B2 | 3/2006 | Koch |
| 7,017,289 | B2 | 3/2006 | Destefanis |
| 7,040,044 | B2 | 5/2006 | Brickner et al. |
| 7,222,444 | B2 | 5/2007 | Hendron et al. |

FOREIGN PATENT DOCUMENTS

| | | |
|---|---|---|
| EP | 1146174 | 6/1999 |
| EP | 1526221 | 4/2005 |

* cited by examiner

TOOL CONTROL SYSTEM

TECHNICAL FIELD

The present disclosure relates generally to a control system and, more particularly, to a control system that regulates motion of a tool.

BACKGROUND

Machines such as, for example, backhoes, excavators, dozers, loaders, motor graders, and other types of heavy equipment use multiple actuators supplied with hydraulic fluid from an engine-driven pump to accomplish a variety of tasks. The actuators (e.g., hydraulic cylinders and motors) are used to move linkage members and tools on the machines including, for example, a boom, a stick, and a bucket. An operator controls movements of the actuators by moving one or more input devices, for example joysticks. Joystick movement manipulates a control valve associated with each actuator to control movement of the boom and stick to position or orient the bucket to perform a task. Typical operator control permits individual controlled movement of each linkage member with a corresponding operator input device, for example, along a specific input device axis. That is, each linkage (e.g. boom, stick, and bucket) is controlled by movement along a specific input device axis of one or more joysticks.

Typical operator control suffers several drawbacks due to the complex coordination required to maneuver the work tool, especially when the work tool attached to a linkage system that allows work tool movement about three or more degrees of freedom. For example, when moving the bucket along a predefined trajectory, the operator must continuously manipulate the joysticks to complete the task. As a result, some tasks may require a high level of skill that must be learned through experience. Even experienced operators may lack the necessary skill to precisely complete complex tasks. Further, operators of all skill levels may become inefficient due to fatigue or boredom when completing routine or repetitive tasks.

One example of an improved system for controlling a machine tool is described in U.S. Pat. No. 6,968,264 (the '264 patent) issued to Cripps on Nov. 22, 2005. The '264 patent discloses a machine including a mechanical arm having a first segment, a second segment, and a tool segment. Each segment pivots about a joint and is moved by one or more actuators. The '264 patent further discloses a system for controlling the mechanical arm by defining a planned path and automatically correcting an actual path of the mechanical arm when it is detected that the actual path differs from the planned path. For example, automatic correction may overcome inefficient movement by the operator due to operator fatigue or sloppy operating commands. The planned path may be stored in a library of planned paths and may be selected based one or more of the following factors: the geometry of the mechanical arm, the planned work task of the mechanical arm, the identity of the machine to which the mechanical arm is operably connected, and an optimal or preferential path of a skilled experienced operator of the machine or mechanical arm.

Although the machine of the '264 patent may improve operation efficiency by automating portions of complex tasks, it may be inefficient and have limited applicability. The machine of the '264 patent may be inefficient because it fails to consider the type or size of tool being used to complete the task. Without considering the type or size of tool being used, the desired tool path may not be as efficient as possible.

Additionally, although it may help ensure the mechanical arm follows a particular path, the '264 patent may be limited because it fails to simplify typical complex operator input controls used to position the mechanical arm.

The disclosed control system is directed to overcoming one or more of the problems set forth above.

SUMMARY

In one aspect, the present disclosure is directed a tool control system. The control system may include a first actuator configured to control a first linkage. The control system may further include a second actuator configured to control a second linkage. The control system may also include a third actuator configured to control a work tool, wherein the second linkage is connected to the work tool and movably connected to the first linkage. The control system may still further include a plurality of operator input devices configured to provide operator control of the first, second, and third actuators. The control system may also include a controller in communication with the first, second, and third actuators and the plurality of operator input devices. The controller may be configured to receive a desired tool path for the work tool. The controller may also be configured to control movement of the first, second, and third actuators based on operator input received from fewer than all of the plurality of operator input devices to move the work tool along the desired tool path.

In another aspect, the present disclosure is directed to a method of controlling movement of a work tool. The method may include determining a tool axis of the work tool. The method may further include setting a desired tool path relative to the tool axis. The method may also include receiving operator input from a single operator input device regarding a desired movement of the work tool along the tool axis. The method may additionally include controlling movement of the work tool about multiple axes along the desired tool path based on the operator input.

DETAILED DESCRIPTION

Figure 1:
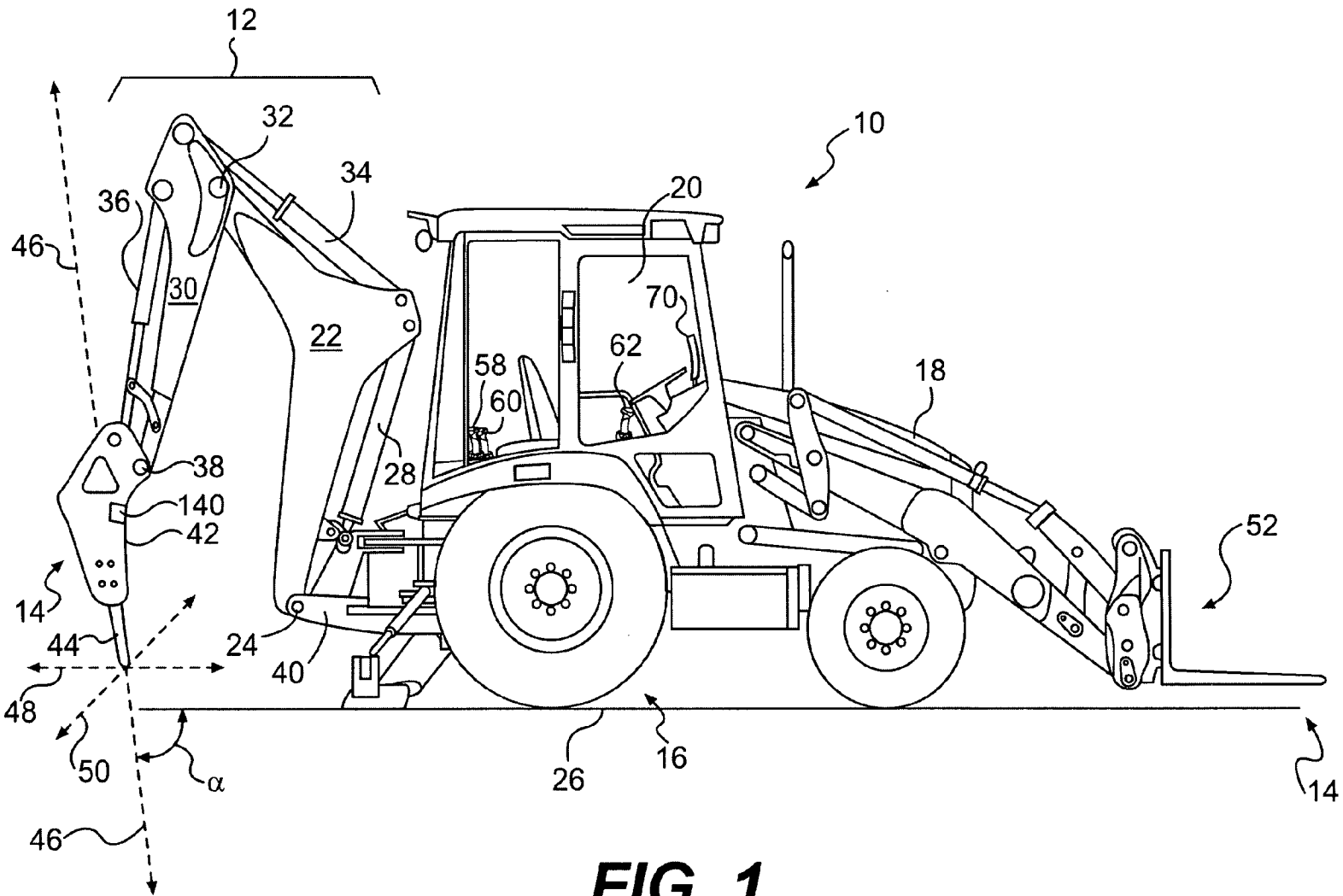
FIG. 1 is a side-view diagrammatic illustration of an exemplary disclosed machine.

FIG. 1 illustrates an exemplary machine 10 having multiple systems and components that cooperate to accomplish a task. Machine 10 may embody a fixed or mobile machine that performs some type of operation associated with an industry such as mining, construction, farming, transportation, or any other industry known in the art. For example, machine 10 may be an earth moving machine such as a backhoe, an excavator, a dozer, a loader, a motor grader, or any other earth moving machine. Machine 10 may include an implement system 12 configured to move a work tool 14, a drive system 16 for propelling machine 10, a power source 18 that provides power to implement system 12 and drive system 16, and an operator station 20 for operator control of implement system 12 and drive system 16.

Power source 18 may embody an engine such as, for example, a diesel engine, a gasoline engine, a gaseous fuel-powered engine or any other type of combustion engine known in the art. It is contemplated that power source 18 may alternatively embody a non-combustion source of power such as a fuel cell, a power storage device, or another source known in the art. Power source 18 may produce a mechanical or electrical power output that may then be converted to hydraulic power for moving implement system 12.

Implement system 12 may include a linkage structure acted on by fluid actuators to move work tool 14. The linkage structure of implement system 12 may be complex, for example, including three or more degrees of freedom. Specifically, implement system 12 may include a boom member 22 vertically pivotal about an axis 24 relative to a work surface 26 by a single, double-acting, hydraulic cylinder 28. Implement system 12 may also include a stick member 30 vertically pivotal about an axis 32 by a single, double-acting, hydraulic cylinder 34. Implement system 12 may further include a single, double-acting, hydraulic cylinder 36 operatively connected to work tool 14 to pivot work tool 14 vertically about an axis 38. Boom member 22 may be pivotally connected at one end to a frame 40 of machine 10. Stick member 30 may pivotally connect an opposing end of boom member 22 and to work tool 14 by way of axes 32 and 38. Movement of boom member 22 about axis 24, stick member 30 about axis 32, and work tool 14 about axis 38 may define three degrees of freedom for implement system 12. It is contemplated that implement system 12 may include a fourth degree of freedom, for example, side-to-side swing movement of implement system 12 generated by a swing motor 92 (shown in FIG. 2) about a pivot (not shown).

Each of hydraulic cylinders 28, 34, and 36 may include a tube and a piston assembly (not shown) arranged to form two separated pressure chambers. The pressure chambers may be selectively supplied with pressurized fluid and drained of the pressurized fluid to cause the piston assembly to displace within the tube, thereby changing the effective length of hydraulic cylinders 28, 34, and 36. The flow rate of fluid into and out of the pressure chambers may relate to a velocity of hydraulic cylinders 28, 34, and 36 while a pressure differential between the two pressure chambers may relate to a force imparted by hydraulic cylinders 28, 34, and 36 on the associated linkage members. The expansion and retraction of hydraulic cylinders 28, 34, and 36 may function to assist in moving work tool 14.

Work tool 14 may include any device used to perform a particular task such as, for example, a bucket, an auger, a blade, a shovel, a ripper, a broom, a snow blower, a cutting device, a grasping device, or any other task-performing device known in the art. Although connected in the embodiment of FIG. 1 to pivot relative to machine 10, work tool 14 may alternatively or additionally rotate, slide, swing, lift, or move in any other manner known in the art. Numerous different work tools 14 may be attachable to machine 10 and controllable via operator station 20. Each work tool 14 may be configured to perform a specialized function.

For example, machine 10 may include a hydraulic hammer 42 attached to implement system 12 and having, for example, a chisel 44 for impacting an object or ground surface 26. An operator may manually or automatically set hydraulic hammer 42 at a desired angle $\alpha$. It is contemplated that desired angle $\alpha$ may be held substantially constant relative to at least two reference points. For example, a first reference point may be a longitudinal axis of chisel 44, and a second reference point may be work surface 26. However, desired angle $\alpha$ of hydraulic hammer 42 may be set relative to other points of reference including a horizon (not shown) or frame 40, if desired. Hydraulic hammer 42 may also include a primary tool axis 46 defined by an axis extending in a desired direction of tool movement. Primary tool axis 46 may be generally coaxial with the longitudinal axis (i.e., first reference point) of chisel 44. Furthermore, hydraulic hammer 42 may include a secondary tool axis 48 that may be substantially parallel to ground surface 26 and extending in a direction away from machine 10. Likewise, hydraulic hammer 42 may include a tertiary tool axis 50 that forms a plane with secondary tool axis 48. In one embodiment, tertiary tool axis 50 may be generally perpendicular to second tool axis 48. While only linear desired tool paths are shown, it is contemplated that non-linear paths may be implemented, for example, arcuate paths.

Operator station 20 may receive input from a machine operator indicative of a desired work tool movement. Specifically, operator station 20 may include one or more operator interface devices embodied as single or multi-axis joysticks located proximal an operator seat. The operator interface devices may include, among other things, a left hand hoe joystick 58, a right hand hoe joystick 60, and a loader joystick 62. Operator interface devices 58-62 may be proportional-type controllers configured to position and/or orient work tool 14 by varying fluid pressure to hydraulic cylinders 28, 34, and 36. For example, operator interface devices 58-62 may impart movement of work tools 14, by moving operator interface devices 58-62 to the left, right, forward, backward, and/or by twisting. Additionally, each operator interface device 58-62 may include one or more triggers 64, 66, and 68 (see FIG. 2), respectively, for receiving operator input. It is contemplated that different operator interface devices may alternatively or additionally be included within operator station 20 such as, for example, wheels, knobs, push-pull devices, switches, pedals, and other operator interface devices known in the art. It is further contemplated that a graphical user interface 70 may be located within operator station 20 to receive operator input. Graphical user interface 70 may include various input interfaces including, for example, drop-down menus.

Figure 2:
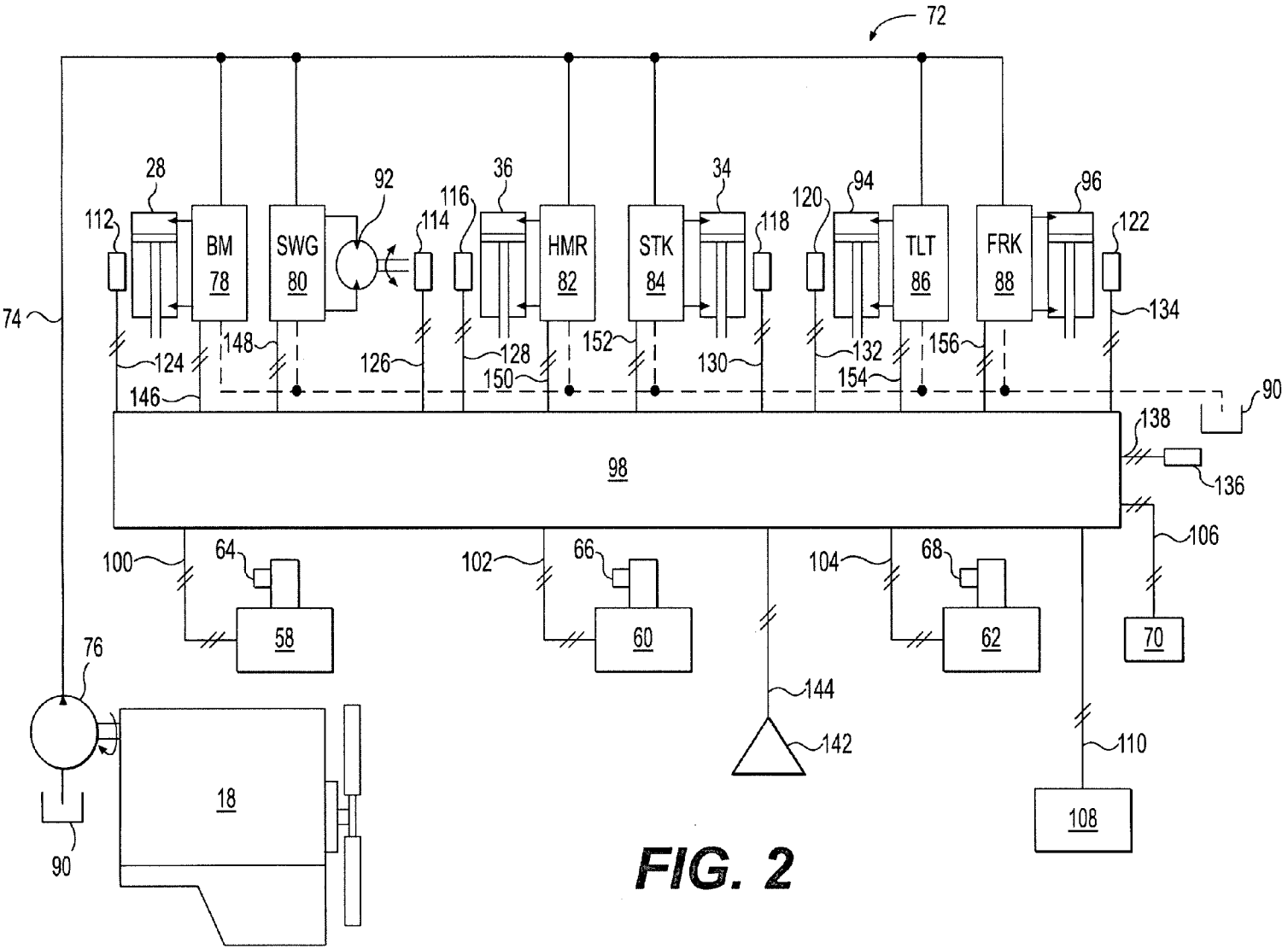
FIG. 2 is a schematic illustration of an exemplary disclosed hydraulic control system that may be used with the machine of FIG. 1.

As illustrated in FIG. 2, machine 10 may include a hydraulic control system 72 having a plurality of fluid components that cooperate to move work tool 14 (referring to FIG. 1). In particular, hydraulic control system 72 may include a supply line 74 configured to receive a first stream of pressurized fluid from a source 76. A boom control valve 78 and a swing control valve 80 may be connected to receive pressurized fluid in parallel from supply line 74 and controlled by left hand hoe joystick 58. A hammer control valve 82 and a stick control valve 84 may also be connected to receive pressurized fluid in parallel from supply line 74 and controlled by right hand hoe joystick 60. A tilt control valve 86 and a fork control valve 88 may also be connected to receive pressurized fluid in parallel from supply line 74 and configured to control movement of a fork arrangement 52 (referring to FIG. 1) by way of loader joystick 62.

Source 76 may draw fluid from one or more tanks 90 and pressurize the fluid to predetermined levels. Specifically, source 76 may embody a pumping mechanism such as a variable displacement pump, a fixed displacement pump, or any other source known in the art. For example, source 76 may include a single pump that supplies pressurized actuator and pilot fluid directed to hydraulic cylinders 28, 34, 36. Source 76 may be drivably connected to power source 18 of machine 10 by, for example, a countershaft, a belt (not shown), an electrical circuit (not shown), or in any other suitable manner. Alternatively, source 76 may be indirectly connected to power source 18 via a torque converter, a reduction gear box, or in any other suitable manner. Further, source 76 may alternatively include separate pumping mechanisms to independently supply actuator and/or pilot fluid to hydraulic cylinders 28, 34, 36, if desired.

Tank 90 may constitute a reservoir configured to hold a supply of fluid. The fluid may include, for example, a dedicated hydraulic oil, an engine lubrication oil, a transmission lubrication oil, or any other fluid known in the art. One or more hydraulic systems within machine 10 may draw fluid from and return fluid to tank 90. It is contemplated that hydraulic control system 72 may be connected to multiple separate fluid tanks or to a single tank.

Each of boom, swing, hammer, stick, tilt and fork control valves 78-88 may regulate the motion of their related fluid actuators. Specifically, boom control valve 78 may have elements movable to control the motion of hydraulic cylinder 28 associated with boom member 22; swing control valve 80 may have elements movable to control a swing motor 92 associated with providing rotational movement of implement system 12; hammer control valve 82 may have elements movable to control the motion of hydraulic cylinder 36 associated with hydraulic hammer 42; and stick control valve 84 may have elements movable to control the motion of hydraulic cylinder 34 associated with stick member 30. Likewise, tilt control valve 86 and fork control valve 88 may each have valve elements movable to control actuators 94, 96, respectively, of fork arrangement 52. It is contemplated that a pair of double acting cylinders may be used as an alternative to swing motor 92 to provide rotational movement of implement system 12, if desired. Similarly contemplated, a motor may be used as an alternative to each hydraulic cylinder 28, 34, 36, 94, and 96 to provide movement to implement system 12 and fork arrangement 52.

One or more sensors may be associated with actuators 28, 92, 34, 36, 94, and 96. More specifically, machine 10 may include a plurality of sensors for monitoring the position and/or velocity of implement system 12 and fork arrangement 52. For example, machine 10 may include a boom sensor 112, a swing sensor 114, a tool sensor 116, a stick sensor 118, and first and second fork sensors 120 and 122. Sensors 112-122 may be any type of sensors capable of monitoring and transmitting position or velocity information of machine 10 and/or work tool 14 to a controller 98. For example, sensors 112-122 may be in-cylinder displacement sensors when cylinder actuators are implemented. Alternatively, sensors 112-122 may employ joint angle sensors, for example, when motor actuators are implemented. It is also contemplated that sensors 112-122 may be sensors capable of determining velocity of an element. For example, sensors 112-122 may be angular velocity sensors. Furthermore, an additional sensor may be associated with determining a relative position of machine 10. For example, machine 10 may include a level sensor 136. Sensor 136 may be any type of sensor capable of detecting a tilt angle of machine 10.

Machine 10 may include controller 98 for receiving information from various input devices and responsively transmitting output commands to control valves 78-88 of hydraulic system 72. Controller 98 may receive signals from operator input devices 58-62 via communication lines 100, 102, and 104, respectively. Further, controller 98 may receive operator input from graphical user interface 70 via communication line 106. Controller 98 may also access a memory storage device 108 via a communication line 110 to retrieve and/or store operational control data contained in memory storage device 108. Controller 98 may further receive information from one or more sensors. For example, controller 98 may receive information from boom sensor 112 via a communication line 124, from swing sensor 114 via a communication line 126, from tool sensor 116 via a communication line 128, from stick sensor 118 via a communication line 130, and from first and second fork sensors 120 and 122 via communication lines 132 and 134, respectively. Additionally, controller 98 may also receive input from level sensor 136 via a communication line 138.

Controller 98 may receive tool identification data for work tool 14, either automatically from a transmitter 140 (shown in FIG. 1) or manually from graphical user interface 70. Automatic transmission may be a wireless transmission, for example, using RF transmissions. A receiver 142 for receiving data from transmitter 140 may be in communication with controller 98 via a communication line 144. After receiving tool identification data, controller 14 may access a look-up table (not shown) that associates tool identification data with a desired angle (e.g., desired angle $\alpha$) and desired tool paths (e.g., tool axes 46-50). In response to defining a desired angle and desired paths for a given type of work tool 14, controller 98 may generate output commands to control valves 78-88 via communication lines 146, 148, 150, 152, 154, and 156, respectively.

Memory storage device 108 may include various tool control strategies associating operator input with tool motion output. More specifically, the various tool controls strategies may define how operator input received via one or more operator input devices 58, 60 results in actual movement of implement system 12. For example, a first control strategy may serve as a default control strategy that may implement individual movement control of each linkage of implement system 12 using both of left and right hand hoe joysticks 58, 60. The default control strategy may require an operator to use left hand hoe joystick 58 to control boom and swing movement, and right hand hoe joystick 60 to control hammer and stick movement. Fore/aft manipulation of left hand hoe joystick 58 may result in movement of boom 22, and side-to-side manipulation may result in swing movement of implement system 12. Fore/aft manipulation of right hand hoe joystick 60 may result in pivoting movement of hydraulic hammer 42, and side-to-side manipulation may result in vertical movement of stick 30. For example, pulling left hand hoe joystick 58 and right hand hoe joystick 58 towards an operator may move boom 22 and stick 30, respectively, closer to operator station 20, and pushing left hand hoe joystick 58 and right hand hoe joystick 60 away may move boom 22 or stick 30, respectively, farther out. Further, pushing left hand hoe joystick 58 to the left may swing implement system 12 to the left, and pushing left hand hoe joystick 58 to the right may swing implement system 12 to the right. Pushing right hand hoe joystick 60 to the left may pivot hydraulic hammer 42 down, and pushing right hand hoe joystick 60 to the right may pivot hydraulic hammer 42 up. Hence, the default control strategy may allow independent operator control of boom movement, stick movement, hammer movement, and swing movement using two multi-axis hoe joysticks 58, 60. In order to move hydraulic hammer 42 along primary tool axis 46, the default control strategy may require a complex coordination of operator input device movements including: fore/aft manipulation of left hand hoe joystick 58, side-to-side manipulation of right hand hoe joystick 60, and fore/aft manipulation of right hand hoe joystick 62.

Memory storage device 108 may store a second control strategy that differs from the default control strategy. The second control strategy may associate operator input with implement output differently than the first control strategy. It is contemplated that the second control strategy may control movement of work tool 14 along a desired tool path with a single operator input device. In one embodiment, second control strategy may be a tool axis control strategy in which a desired tool path may correspond with an axis of work tool 14. Each work tool 14 may include various tool axes based on characteristics or physical features of work tool 14. For example, the desire tool path may be defined by primary tool axis 46, secondary tool axis 48, or tertiary tool axis 50. As shown in FIG. 1, hydraulic hammer 42 may include primary tool axis 46 that is substantially coaxial with a longitudinal axis of chisel 44. The tool axis control strategy may limit movement of hydraulic hammer 42 along a desired tool path that is substantially coaxial with primary tool axis 46. In other words, when implementing the tool axis control strategy, controller 98 may selectively modulate operation of one or more of actuators 28, 92, 34, and 36 in response to input received from only a single axis of movement of an operator input device, such that work tool 14 follows a desired tool path. For example, fore/aft manipulation of left hand hoe joystick 58 may result in movement of hydraulic hammer 42 along primary tool axis 46, fore/aft manipulation of right hand hoe joystick 60 may result in movement of hydraulic hammer 42 along secondary tool axis 48, and side-to-side manipulation of left hand hoe joystick 58 may result in movement of hydraulic hammer 42 along tertiary tool axis 50.

Figure 3:
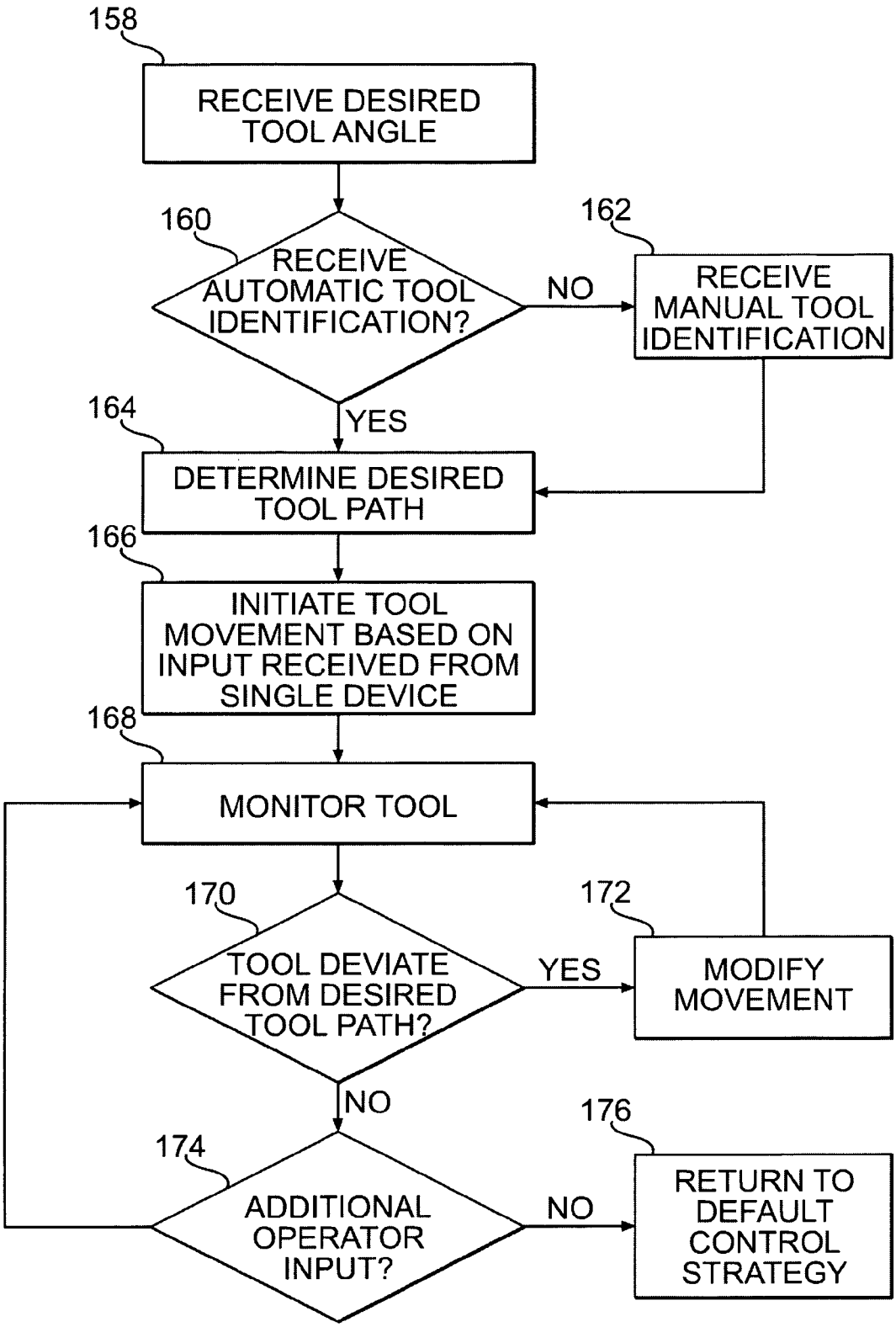
FIG. 3 is a control diagram illustrating an exemplary method of operating the hydraulic control system of FIG. 2.

FIG. 3 shows a control diagram implementing a tool axis control strategy for controlling movement of a work tool. FIG. 3 will be discussed in detail in the following section.

INDUSTRIAL APPLICABILITY

The disclosed control system may be applicable to any machine that includes operator control of a work tool by way of a plurality of different actuators. The disclosed control system may increase operational efficiency by selectively implementing a constant tool angle strategy and a tool axis control strategy that automates control over some of the actuators such that overall control of the tool is simplified for the operator. For purposes of explanation, only operational control of implement system 12 with reference to hydraulic hammer 42 will be described in detail. The operation of hydraulic control system 72 will now be explained.

An operator may implement the first control strategy (i.e., the default control strategy) for independently actuating movement of each linkage (e.g., boom 22, stick 30, and hydraulic hammer 42) by manipulating operator input devices 58 and 60. The first control strategy may require an operator to use left hand hoe joystick 58 to control boom and swing movement, and right hand hoe joystick 60 to control hammer and stick movement.

In certain situations the second control strategy (i.e., the tool axis control strategy) may be preferred over the first control strategy. For example, when an operator selects hydraulic hammer 42 to complete a task, control of hydraulic hammer 42 may be more efficient when moved along a desired tool path with a single operator input device (e.g., left hand hoe joystick 58). While it may be possible for a skilled operator to generally follow the desired tool path using the first control strategy, the second control strategy may help operators successfully complete the task without the need for complex coordination of multiple operator input devices (i.e., joysticks 58, 60).

As shown in FIG. 3, operation of the second control strategy may begin when controller 98 receives desired angle $\alpha$ for hydraulic hammer 42 (Step 158). The desired angle $\alpha$ may be manually set by the operator to maintain hydraulic hammer 42 at a desired angle relative to a reference point, for example, relative to ground surface 26. An operator may notify controller 98 of the desired angle $\alpha$ by, for example, pulling trigger 64 of left hand hoe joystick 58 when work tool 14 has been manually oriented to desired angle $\alpha$. When trigger 64 has been pulled, the relative position of hydraulic hammer 42 may be sensed by sensors 112-118, and corresponding position data may be temporarily or permanently stored in memory storage device 108. In response to an operator setting desired angle $\alpha$, controller 98 may send command signals to control valves 78-84 to maintain hydraulic hammer 42 at desired angle $\alpha$ when an operator commands movement of implement system 12, even if those commands would normally (i.e., via default control strategy) have moved work tool 14 away from desired angle $\alpha$. As an alternative to an operator manually positioning work tool 14 to set the desired angle $\alpha$, controller 98 may automatically command control valve 82 to move work tool 14 to desired angle $\alpha$ based on tool identification data received from transmitter 140 or inputted by an operator via graphical user interface 70.

After receiving desired angle $\alpha$, controller 98 may receive work tool identification automatically (Step 160) or manually (Step 162) to determine at least one work took characteristic. Based on the work tool characteristic, controller 98 may determine a desired tool path (i.e., a chisel path coaxially aligned with primary tool axis 46) for controlling movement of hydraulic hammer 42 (Step 164). Using the tool axis control strategy, a single operator input device may serve to control movement of work tool 14. For example, fore/aft manipulation of left hand hoe joystick 58 may be designated to serve as the sole input device for moving hydraulic hammer 42 along primary tool axis 46. Operation of work tool 14 may be initiated when controller 98 receives operator commands from left hand hoe joystick 58 (Step 166). An exemplary control may include, pushing left hand hoe joystick 58 away from an operator to lower hydraulic hammer 42 along the desired tool path, and pulling left hand hoe joystick 58 toward an operator to raise hydraulic hammer 42 along the desired tool path. Hence, hydraulic hammer 42 may be moved about 3 degrees of freedom (pivot axes 24, 32, and 38) in response to manipulation of only a single input axis (i.e., fore/aft movement) of an operator input device (i.e., left hand hoe joystick 58).

As the operator manipulates the single operator input device (e.g., fore/aft manipulation of left hand hoe joystick 58), the movement of boom 22, stick 30, and hydraulic hammer 42 may be automatically coordinated by controller 98 to help ensure that hydraulic hammer 42 remains within a predetermined distance of primary tool axis 46 as it moves toward and away from ground surface 26 at desired angle $\alpha$. For example, the predetermined distance may be set to a radial value of about 25 mm. Therefore, deviation from primary tool axis 46 by, for example, 30 mm may result in a correction to the position of hydraulic hammer 42. Monitoring of implement system 12 may be necessary to sense when hydraulic hammer 42 exceeds the predetermined distance value (Step 168). Sensors 112-118 may monitor the position and/or velocity of each linkage (i.e., boom 22, stick, 30, hydraulic hammer 42) of implement system 12 and then transmit movement data to controller 98 via communication lines 124-130, respectively.

Controller 98 may calculate the actual position of hydraulic hammer 42 based on the position data and compare the actual position to primary tool axis 46 to determine a discrepancy (Step 170). For example, actual position data may be determined using trigonometric calculations and known kinematics of machine 10. Alternatively, controller 98 may determine actual position data using a series of tables that map position data of implement system 12. When the difference between the actual position of hydraulic hammer 42 and the desired tool path (i.e., primary tool axis 46) exceeds the predetermined distance value, then controller 98 may modify movement of implement system 12 (Step 172).

After observing a discrepancy between the actual position of hydraulic hammer 42 and the desired tool path that exceeds the predetermined distance value, controller 98 may determine the movement of actuators 28, 92, 36, and 34 and corresponding adjustments of control valves 78-84 necessary to correct the discrepancy. For example, controller 98 may rely upon inverse kinematics calculations to convert a desired work tool position (i.e., a desired tool path substantially coaxially aligned with primary tool axis 46) and orientation (i.e., desired angle $\alpha$) to desired control valve commands that adjust the position and orientation of hydraulic hammer 42 to substantially match the desired path (i.e., primary tool axis 46) and desired angle $\alpha$. Controller 98 may send commands to control valves 78-84 to ensure that movement of hydraulic hammer 42 substantially follows primary tool axis 46. After completion of tasks that benefit from tool axis control (Step 174), an operator may cancel operation of the second control strategy (e.g., tool axis control) and return to the first control strategy (e.g. default control) (Step 176).

The following example describes an exemplary task that may benefit from the tool axis controls strategy. Hydraulic hammer 42 may be required to break a large area of material, for example, a rectangular concrete pad. When the tool axis control strategy is selected, an operator may initiate breaking the concrete pad at a first location directly in front of the operator and centered with machine 10 by moving hydraulic hammer 42 along primary tool axis 46 using only fore/aft manipulation of left hand hoe joystick 58). Once the operator has sufficiently broken the concrete at the first location, the operator may move hydraulic hammer to a second location, for example, further away from machine 10 but still centered relative machine 10. In order to move hydraulic hammer 42 away from machine 10 to second location, the operator may move hydraulic hammer 42 along secondary tool axis 48 with only fore/aft manipulation of right hand hoe joystick 60. Once hydraulic hammer 42 is moved over the second location, then the operator may move hydraulic hammer 42 along primary tool axis 46 to break the concrete at the second location. To break the concrete pad at a third location, for example, equally distant away from machine 10 as the second location, but to the right of the second location, the operator may move hydraulic hammer 42 along tertiary tool axis 50 with only side-to-side manipulation of left hand hoe joystick 58. Once over the third location, the operator may break a portion of the concrete pad below the third location by moving hydraulic hammer 42 along primary tool axis 46. Therefore, an operator may systematically move hydraulic hammer 42 over the entire concrete pad using the tool axis control strategy.

The tool axis control strategy may help improve machine operational efficiency by minimizing the number of input devices an operator must control to complete complex tasks. A reduction in the number of input devices an operator must control may reduce operator mental and physical fatigue during the completion of routine tasks.

It will be apparent to those skilled in the art that various modifications and variations can be made to the disclosed control system without departing from the scope of the disclosure. Other embodiments of the control system will be apparent to those skilled in the art from consideration of the specification and practice of the control system disclosed herein. It is intended that the specification and examples be considered as exemplary only, with a true scope of the disclosure being indicated by the following claims and their equivalents.

LIST OF ELEMENTS

10. Machine
12. Implement System
14. Work Tool
16. Drive System
18. Power Source
20. Operator Station
22. Boom
24. Axis
26. Work Surface
28. Cylinder
30. Stick
32. Axis
34. Cylinder
36. Cylinder
38. Axis
40. Frame
42. Hydraulic Hammer
44. Chisel
46. Primary Tool Axis
48. Secondary Tool Axis
50. Tertiary Tool Axis
52. Fork Arrangement
58. Left Hand Hoe Joystick
60. Right Hand Hoe Joystick
62. Loader Joystick
64. Trigger
66. Trigger
68. Trigger
70. Graphical User Interface
72. Hydraulic System
74. Supply Line
76. Source
78. Boom Control Valve
80. Swing Control Valve
82. Hammer Control Valve
84. Stick Control Valve
86. Tilt Control Valve
88. Fork Control Valve
90. Tank
92. Swing Motor
94. Actuator
96. Actuator
98. Controller
100. Communication Line
102. Communication Line
104. Communication Line
106. Communication Line
108. Memory Storage Device
110. Communication Line
112. Boom Sensor
114. Swing Sensor
116. Tool Sensor
118. Stick Sensor
120. Fork Sensor
122. Fork Sensor
124. Communication Line
126. Communication Line
128. Communication Line
130. Communication Line
132. Communication Line
134. Communication Line
136. Level Sensor
138. Communication Line
140. Transmitter
142. Receiver

144. Communication Line
146. Communication Line
148. Communication Line
150. Communication Line
152. Communication Line
154. Communication Line
156. Communication Line
158. Control Block—Receive Desired Angle
160. Control Block—Automatic Tool Identification
162 Control Block—Manual Tool Identification
164. Control Block—Determine Desired Tool Path
166. Control Block—Initiate Tool Movement
168. Control Block—Monitor Tool
170. Control Block—Determine Discrepancy
172. Control Block—Modify Movement
174. Control Block—Additional Operator Input
176. Control Block—Return to Default Control Strategy

What is claimed is:

1. A tool control system, comprising:

a first actuator configured to control movement of a first linkage;

a second actuator configured to control movement of a second linkage;

a third actuator configured to control movement of a work tool, wherein the second linkage is connected to the work tool and movably connected to the first linkage;

a plurality of operator input devices configured to provide operator input to the movement of the first linkage, the second linkage, and the work tool; and a controller in communication with the first, second, and third actuators and the plurality of operator input devices, the controller being configured to move the work tool in a desired tool path using multiple control modes, the controller being further configured to receive identification data that identifies a type of the work tool and to select one of a first control mode or a second control mode of the multiple control modes based on the received identification data, the second control mode being different from the first control mode, wherein in the first control mode, movement of an operator input device of the plurality of operator input devices in a first direction moves the work tool along a first path, and in the second control mode, movement of the operator input device in the first direction moves the work tool along a second path different from the first path.

2. The system of claim 1, wherein the first linkage is a boom member and the second linkage is a stick member.

3. The system of claim 1, wherein the first actuator is a swing actuator configured to control side-to-side movement of the first linkage.

4. The system of claim 1, further including at least one sensor configured to monitor movement of the work tool relative to the desired tool path.

5. The system of claim 4, wherein the desired tool path corresponds to a tool axis of the work tool.

6. The system of claim 4, wherein the controller is further configured to:

receive work tool movement data from the at least one sensor and determine an actual position of the work tool;

determine a discrepancy value between the actual position of the work tool and the desired tool path; and control movement of at least one of the first and second actuators to reduce the discrepancy value to below a predetermined value.

7. The system of claim 1, wherein the second linkage is pivotally connected to the first linkage and the work tool.

8. The system of claim 1, wherein the controller if is further configured to receive the identification data from the work tool.

9. The system of claim 8, wherein the the controller is configured to receive the identification data from a graphical user interface.

10. The system of claim 1, wherein the controller is further configured to receive a desired angle for the work tool.

11. The system of claim 1, wherein the first path is movement of the work tool along a linear axis and the second path is movement of the work tool along a curved axis.

12. A tool control system of a machine, comprising:

a boom member pivotally connected to frame of the machine;

a first actuator configured to control movement of the boom member;

a stick member pivotally connected to the boom member;

a second actuator configured to control movement of the stick member;

a work tool pivotally connected to the stick member;

a third actuator configured to control movement of the work tool;

a first operator input device and a second operator input device, the first and the second operator input devices being movable by an operator to actuate at least one of the first, second, and third actuators; and a controller configured to detect a type of the work tool coupled to the machine and selectively operate in one of a first operating mode and a second operating mode based on the detected type, wherein in the first operating mode, moving the first operator input device in a first direction moves the work tool along a first path, and in the second operating mode, moving the first operator input device in the first direction moves the work tool in a second path different from the first path.

13. The tool control system of claim 12, wherein in the second operating mode, the controller is further configured to use sensor inputs to determine an actual position of the work tool as the work tool moves in the second tool path, and determine a discrepancy value between the actual position of the work tool and a desired tool path.

14. The tool control system of claim 13, wherein the controller is further configured to adjust the movement of the work tool to decrease the discrepancy value.

15. The tool control system of claim 12, further including one or more sensors configured to monitor a position and a velocity of the work tool.

16. The tool control system of claim 12, wherein the controller is configured to detect the type of the work tool based on a communication from the work tool.

17. The tool control system of claim 12, wherein the controller is configured to detect the type of the work tool based on input from an operator of the machine.

18. The tool control system of claim 12, wherein the first path is movement of the work tool along a linear axis and the second path is movement of the work tool along a curved axis.

19. A method of operating a tool control system, comprising:

actuating a first actuator to move a first linkage;

actuating a second actuator to move a second linkage;

actuating a third actuator to move a work tool, wherein the second linkage is connected to the work tool and movably connected to the first linkage;

receiving operator input to control the movement of the first linkage, the second linkage, and the work tool using a plurality of operator input devices;

communicating to the tool control system, identification data that identifies a type of the work tool; and selecting using the control system, one of a first control mode or a second control mode based on the identification data, the second control mode being different from the first control mode, wherein in the first control mode, movement of an operator input device of the plurality of operator input devices in a first direction moves the work tool along a first path, and in the second control mode, movement of the operator input device in the first direction moves the work tool along a second path different from the first path.

20. The method of claim 19, wherein communicating to the control system includes transfer of identification data from the work tool to the control system.

* * * * *